US010690148B2

(12) United States Patent
Sishtla

(10) Patent No.: US 10,690,148 B2
(45) Date of Patent: Jun. 23, 2020

(54) DIFFUSER RESTRICTION RING

(71) Applicant: Carrier Corporation, Jupiter, FL (US)

(72) Inventor: Vishnu M. Sishtla, Manlius, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 180 days.

(21) Appl. No.: 15/735,649

(22) PCT Filed: Jul. 21, 2016

(86) PCT No.: PCT/US2016/043299

§ 371 (c)(1),
(2) Date: Dec. 12, 2017

(87) PCT Pub. No.: WO2017/015443

PCT Pub. Date: Jan. 26, 2017

(65) Prior Publication Data

US 2018/0355890 A1 Dec. 13, 2018

Related U.S. Application Data

(60) Provisional application No. 62/195,733, filed on Jul. 22, 2015.

(51) Int. Cl.
*F04D 29/66* (2006.01)
*F04D 17/12* (2006.01)
(Continued)

(52) U.S. Cl.
CPC ..... *F04D 29/664* (2013.01); *F04D 17/122* (2013.01); *F04D 29/023* (2013.01);
(Continued)

(58) Field of Classification Search
CPC .... F04D 29/664; F04D 29/663; F04D 29/524; F04D 29/464; F04D 29/441; F04D 29/023; F04D 17/122; F04D 29/66
See application file for complete search history.

(56) References Cited

U.S. PATENT DOCUMENTS 2,803,396 A 8/1957 Darrow
3,362,625 A 1/1968 Endress
(Continued)

FOREIGN PATENT DOCUMENTS

CN 1651734 A 8/2005
CN 104575482 A 4/2014
(Continued)

OTHER PUBLICATIONS

International Search Report and Written Opinion dated Oct. 26, 2016 for PCT Patent Application No. PCT/US2016/043299.
(Continued)

*Primary Examiner* — Richard A Edgar
*Assistant Examiner* — Maxime M Adjagbe
(74) *Attorney, Agent, or Firm* — Bachman & LaPointe, P.C.

(57) ABSTRACT

A centrifugal compressor (20) comprises: a housing (26); an impeller (34) having an axial inlet (70) and a radial outlet (72); a diffuser (82); and a control ring (90) mounted for shifting between an inserted position and a retracted position. The control ring comprises means (150, 160, 162, 166) for absorbing pulsations.

21 Claims, 7 Drawing Sheets

(51) Int. Cl.

| | |
|---|---|
| ***F04D 29/46*** | (2006.01) |
| ***F04D 29/02*** | (2006.01) |
| *F04D 29/28* | (2006.01) |
| *F04D 29/44* | (2006.01) |

(52) U.S. Cl.
CPC ..... *F04D 29/464* (2013.01); *F04D 29/284* (2013.01); *F04D 29/441* (2013.01); *F05D 2250/52* (2013.01)

(56) References Cited

U.S. PATENT DOCUMENTS

| | | | |
|---|---|---|---|
| 3,784,318 | A | 1/1974 | Davis |
| 4,219,305 | A | 8/1980 | Mount et al. |
| 4,265,589 | A | 5/1981 | Watson et al. |
| 4,378,194 | A | 3/1983 | Bandukwalla |
| 4,416,583 | A | 11/1983 | Byrns |
| 4,626,168 | A | 12/1986 | Osborne et al. |
| 4,643,639 | A | 2/1987 | Caine |
| 4,802,817 | A | 2/1989 | Tyler |
| 5,249,919 | A | 10/1993 | Sishtla et al. |
| 2002/0004004 | A1 | 1/2002 | Fledersbacher et al. |
| 2011/0041494 | A1* | 2/2011 | Parker ..... F01D 21/045 60/605.1 |
| 2013/0115052 | A1* | 5/2013 | Lee ..... F04D 29/444 415/119 |
| 2014/0182317 | A1 | 7/2014 | Sishtla et al. |
| 2014/0356138 | A1* | 12/2014 | Sun ..... F04D 27/0261 415/148 |
| 2015/0275917 | A1* | 10/2015 | Fukuyama ..... F04D 27/0253 415/148 |

FOREIGN PATENT DOCUMENTS

| | | | |
|---|---|---|---|
| EP | 0012895 | A1 | 7/1980 |
| EP | 0896157 | A1 | 2/1999 |
| GB | 1120275 | | 7/1968 |
| GB | 2192231 | A | 1/1988 |
| KR | 20130091971 | A | 8/2013 |

OTHER PUBLICATIONS

Chinese Office Action dated Jul. 1, 2019 for Chinese Patent Application No. 201680042822.3.
Chinese Office Action dated Mar. 3, 2020 for Chinese Patent Application No. 201680042822.3.

* cited by examiner

DIFFUSER RESTRICTION RING

CROSS-REFERENCE TO RELATED APPLICATION

Benefit is claimed of U.S. Patent Application No. 62/195,733, filed Jul. 22, 2015, and entitled "Diffuser Restriction Ring", the disclosure of which is incorporated by reference herein in its entirety as if set forth at length.

BACKGROUND

The disclosure relates to centrifugal compressors. More particularly, the disclosure relates to diffuser restriction/control rings.

U.S. Pat. No. 3,362,625 to Endress, Jan. 9, 1968, discloses an axially shiftable diffuser restriction ring positioned to intervene radially between an impeller outlet and a diffuser inlet. In a high capacity operating condition the ring is in a relatively retracted position. To reduce capacity, the ring is shifted toward a relatively inserted position, progressively occluding/throttling communication from the impeller outlet to the diffuser inlet. Various other compressors have various configurations of axially shiftable diffuser restriction rings. A variety of actuators exist for such rings ranging from purely hydraulic or pneumatic (e.g., where the ring is effectively a piston) to mechanical linkages whose ultimate actuator may be hydraulic or pneumatic or may be a motor, electromagnetic actuator, or the like.

SUMMARY

One aspect of the disclosure involves a centrifugal compressor comprising: a housing; an impeller having an axial inlet and a radial outlet; a diffuser; and a control ring mounted for shifting between an inserted position and a retracted position. The control ring comprises means for absorbing pulsations.

In one or more embodiments of any of the foregoing embodiments, the means may comprise a sleeve portion of the control ring having a pulsation-damping material.

In one or more embodiments of any of the foregoing embodiments, the means may comprise a sleeve portion of the control ring having a foraminate layer.

Another aspect of the disclosure involves a centrifugal compressor comprising: a housing; an impeller having an axial inlet and a radial outlet; a diffuser; and a control ring mounted for shifting between an inserted position and a retracted position. The control ring comprises a sleeve portion having a foraminate layer.

In one or more embodiments of any of the foregoing embodiments, the sleeve portion of the control ring may have a pulsation-damping material.

In one or more embodiments of any of the foregoing embodiments: the foraminate layer may be a radially inboard foraminate layer; the sleeve portion may have a radially outboard foraminate layer; and the pulsation-damping material may be between the inboard foraminate layer and the outboard foraminate layer.

In one or more embodiments of any of the foregoing embodiments, the means may absorb said pulsations associated with a passing frequency of the impeller.

In one or more embodiments of any of the foregoing embodiments, the pulsation-damping material may comprise fiber.

In one or more embodiments of any of the foregoing embodiments, the pulsation-damping material may comprise expanded bead material.

In one or more embodiments of any of the foregoing embodiments, the pulsation-damping material may comprise a circumferential array of segments.

In one or more embodiments of any of the foregoing embodiments, the pulsation-damping material may have a thickness of at least 3 mm.

In one or more embodiments of any of the foregoing embodiments, the foraminate layer may be metallic.

In one or more embodiments of any of the foregoing embodiments, the foraminate layer may comprise drilled holes.

In one or more embodiments of any of the foregoing embodiments, the diffuser may be a pipe diffuser.

In one or more embodiments of any of the foregoing embodiments, the impeller may be a shrouded impeller.

In one or more embodiments of any of the foregoing embodiments: the compressor may be a two-stage compressor; and the impeller may be a second stage impeller downstream of a first stage impeller.

In one or more embodiments of any of the foregoing embodiments, a method for using the centrifugal compressor may comprise: rotating the impeller to drive a fluid flow; and shifting the control ring between the retracted condition and the inserted condition.

In one or more embodiments of any of the foregoing embodiments, the shifting may be a combined axial shift along an axis of the impeller and a rotation about the axis.

In one or more embodiments of any of the foregoing embodiments, during the shifting, the means or the foraminate layer may contact the fluid flow.

In one or more embodiments of any of the foregoing embodiments, a method for manufacturing the centrifugal compressor may comprise: removing a first control ring lacking said means or said foraminate layer; and installing said control ring in place of said first control ring.

In one or more embodiments of any of the foregoing embodiments, the first control ring may be a monolithic metallic ring.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
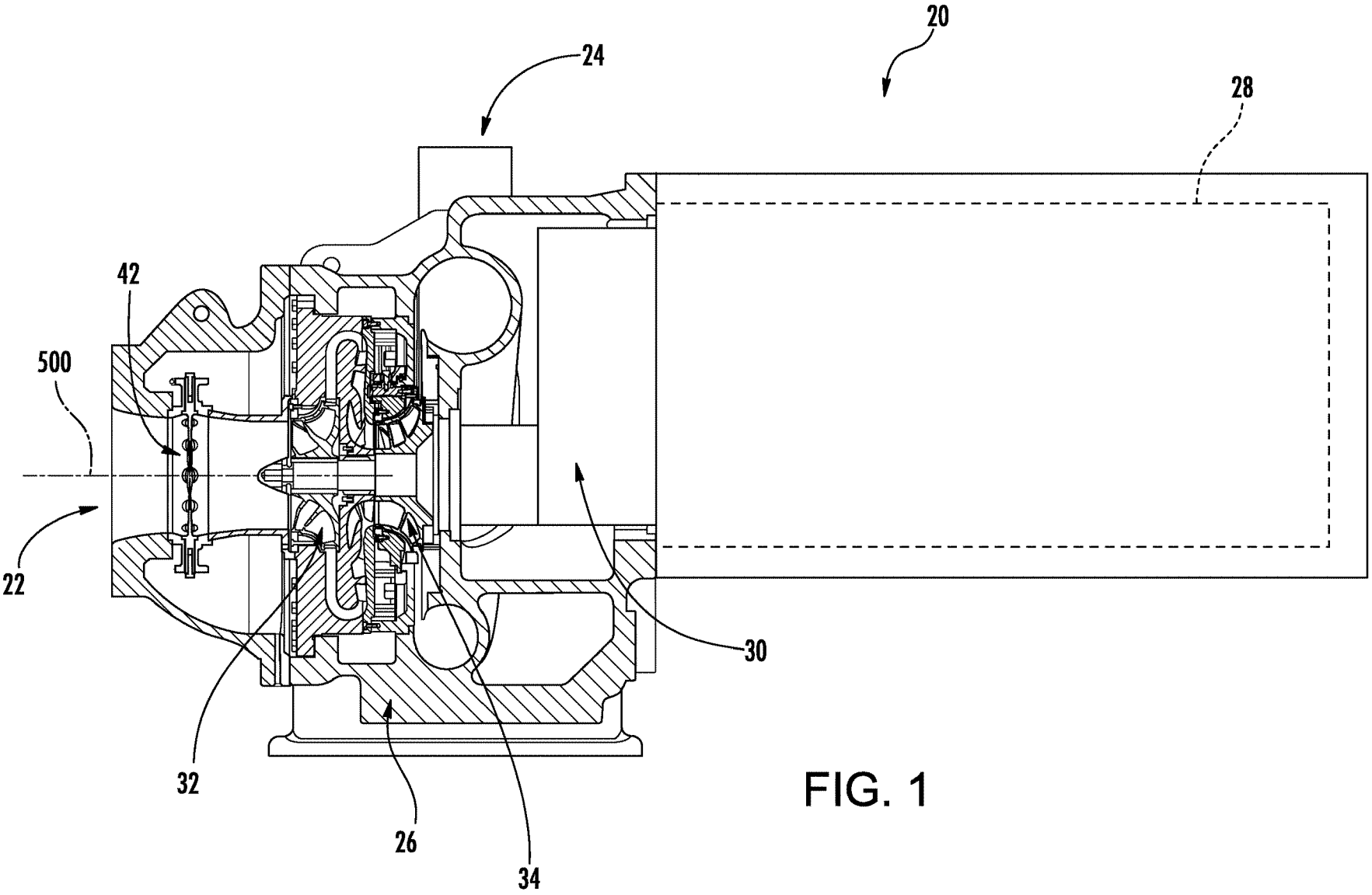
FIG. 1 is a partially schematic longitudinal sectional view of a centrifugal compressor.
Figure 2:
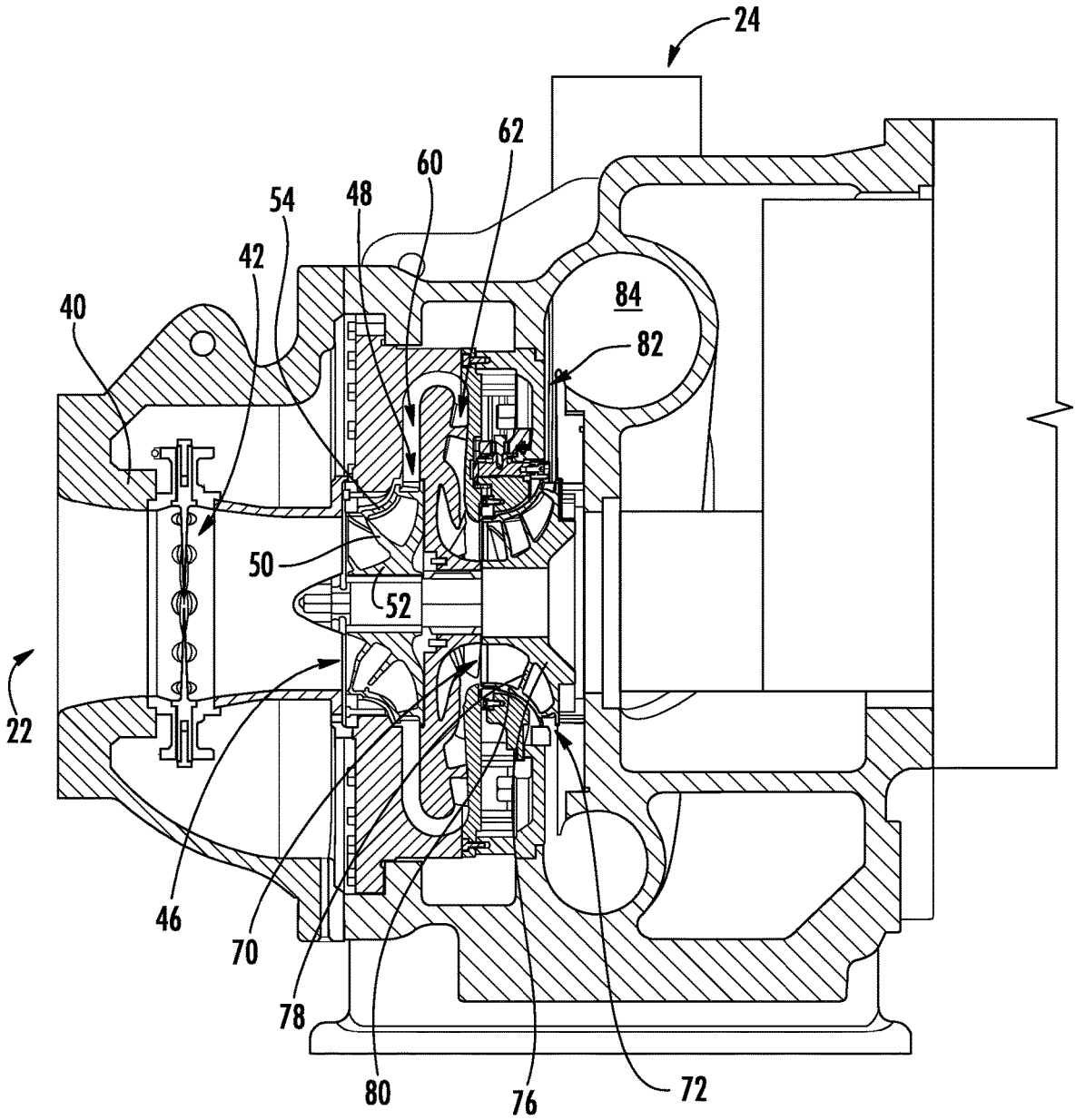
FIG. 2 is an enlarged view of a forward end of the compressor of FIG. 1.

FIG. 1 shows a centrifugal compressor 20 having an inlet or suction port 22 and an outlet or discharge port 24. The ports are formed along a housing (housing assembly) 26. The housing assembly may also contain a motor 28 (i.e., an electric motor having a stator and a rotor). The exemplary compressor is a two-stage indirect drive compressor wherein a gearbox or other transmission 30 intervenes between the motor and the impellers 32, 34 to drive the impellers about an axis 500 at a speed greater than the rotational speed of the motor rotor about its axis. As is discussed below, alternative compressors may include direct drive compressors, single stage compressors, and compressors where the two stages are at opposite ends of a motor, among yet further variations.

From inlet to outlet, a flowpath through the compressor proceeds sequentially through an inlet housing 40 of the housing assembly. The exemplary inlet housing 40 contains an inlet guide vane (IGV) array 42. The inlet guide vanes may be rotated in unison about their respective axes to throttle and unthrottle the inlet flow. At the downstream end of the inlet housing is the inlet 46 to the first stage impeller 32. The inlet 46 is an axial inlet and the first stage impeller 32 has a radial outlet 48. The exemplary impeller 32 has a circumferential array of blades 50 extending between the inlet 46 and outlet 48 and extending between a hub 52 and a shroud 54. Alternative impellers are unshrouded.

Flow from the first stage impeller outlet 48 proceeds radially outward through a diffuser 60 and then back radially inward through a return 62 (itself having an array of vanes). The return 62 turns the flow back axially to encounter the inlet 70 of the second stage impeller 34. The second stage impeller itself also has a radial outlet 72, a hub 76, blades 78, and an optional shroud 80.

Figure 3:
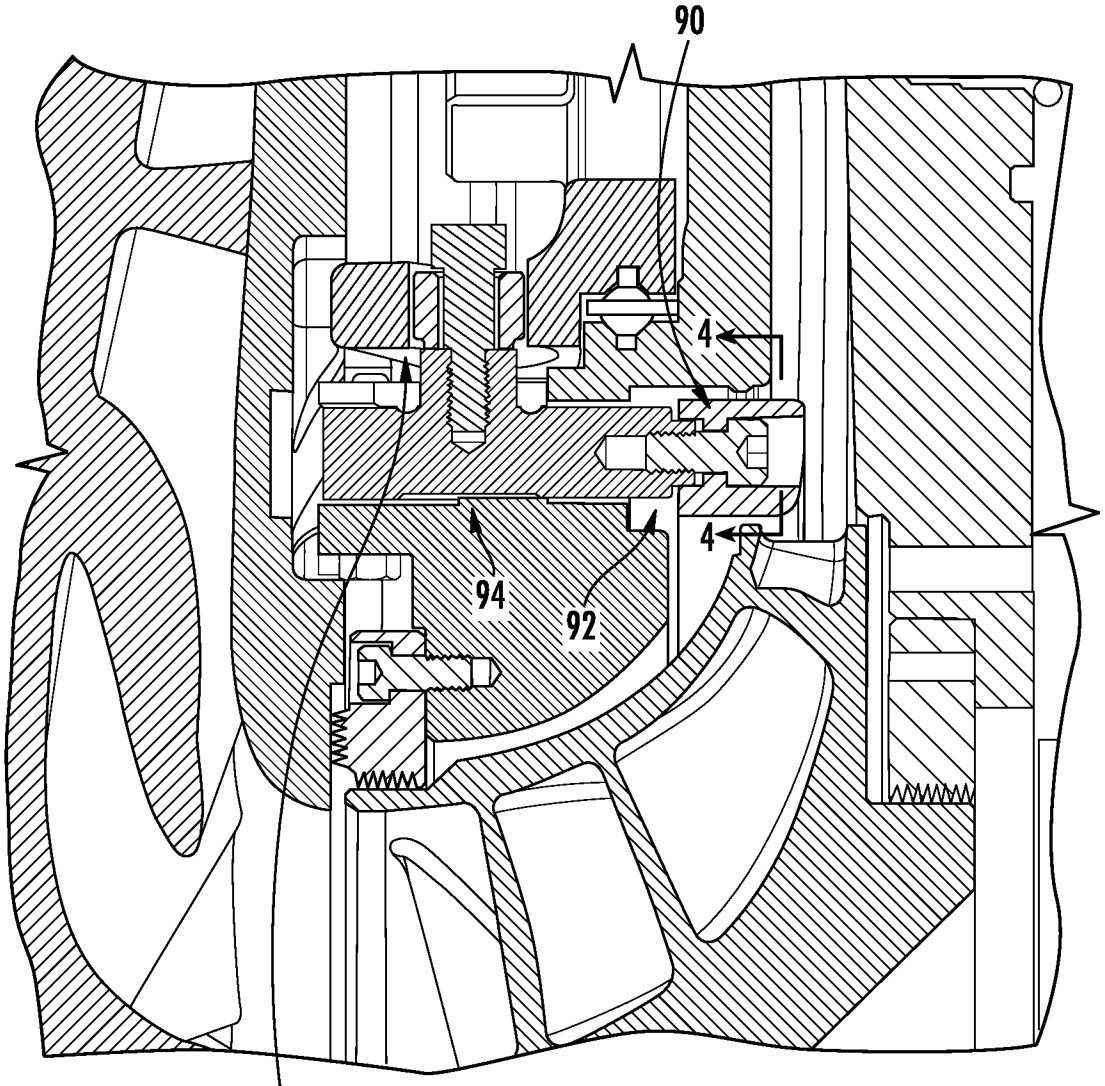
FIG. 3 is an enlarged view of a second stage impeller outlet area of the compressor of FIG. 2.

Flow discharged from the second stage impeller outlet 72 passes radially outward through a diffuser 82 into a discharge chamber or collector 84 and therefrom out the discharge port 24. For throttling the second stage discharge flow, the compressor has a diffuser restriction ring 90 (FIG. 3). The exemplary ring 90 is mounted to an axially shiftable carrier 92 in turn mounted to an actuator means 94. As noted above, exemplary actuator means include direct hydraulic or pneumatic actuators, indirect actuators using a linkage (e.g., 96 shown) and the like. The nature of indirect actuators means their axial shift is often accompanied by a slight rotation of the diffuser restriction ring 90 and its carrier 92 about the axis 500. Direct hydraulic or pneumatic actuation is more likely to be an exclusively axial shift.

The axial shift may be between a relatively retracted condition with relatively limited flow restriction and a relatively inserted condition with relatively greater flow restriction. In this particular example, the insertion direction is away from the compressor inlet 22 parallel to the axis 500; the retraction direction is opposite.

Figure 4:
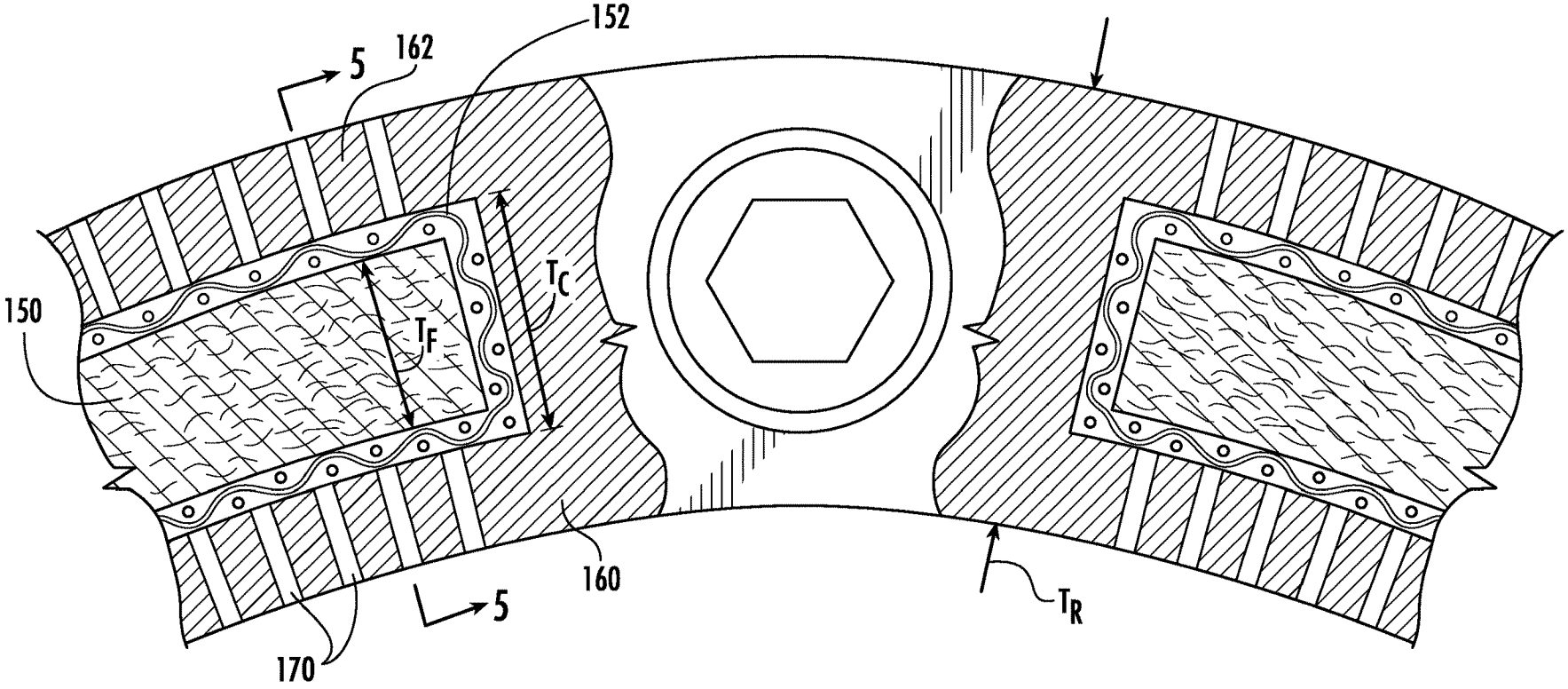
FIG. 4 is a partial transverse sectional view of a diffuser restriction ring taken along line 4-4 of the compressor of FIG. 3.
Figure 5:
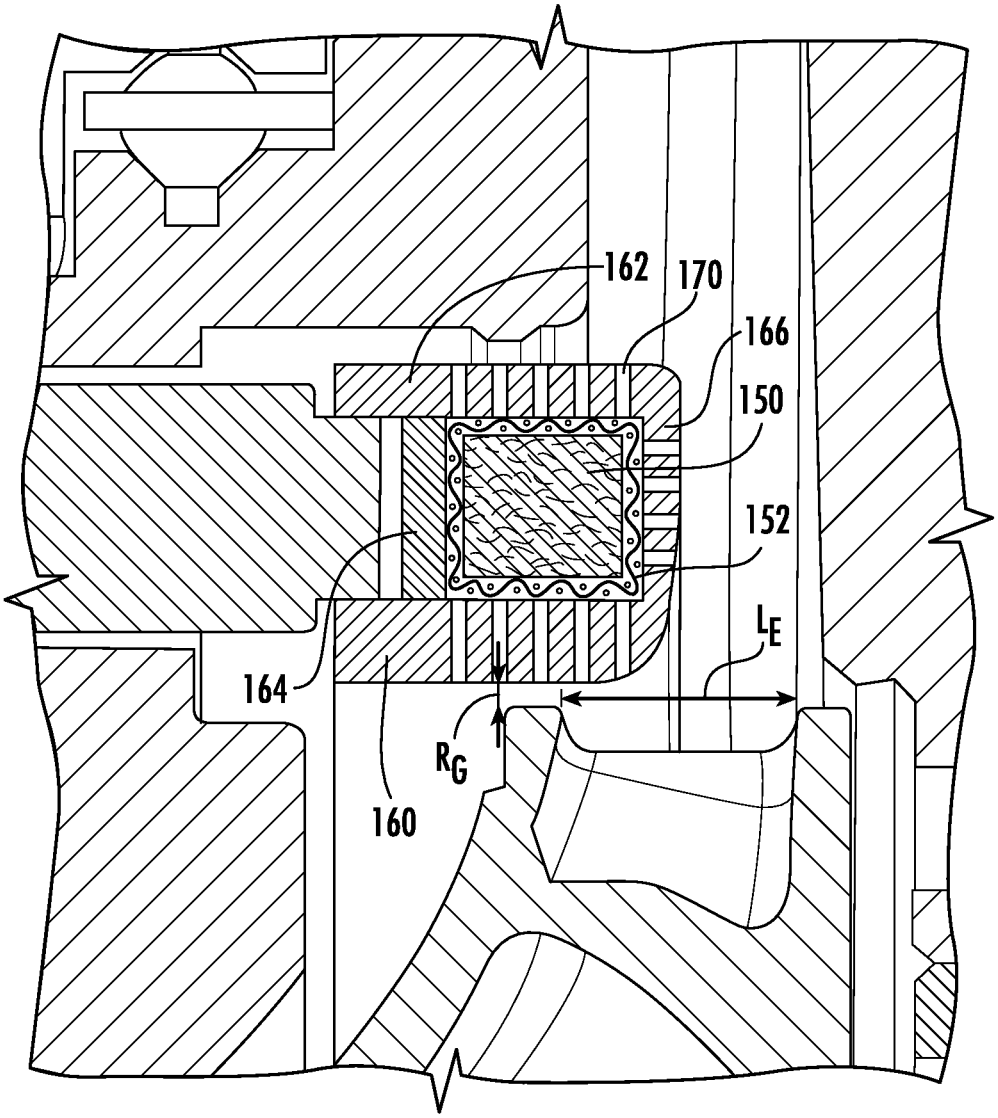
FIG. 5 is a longitudinal sectional view of the ring of FIG. 4 taken along line 5-5 of FIG. 4.
Figure 6:
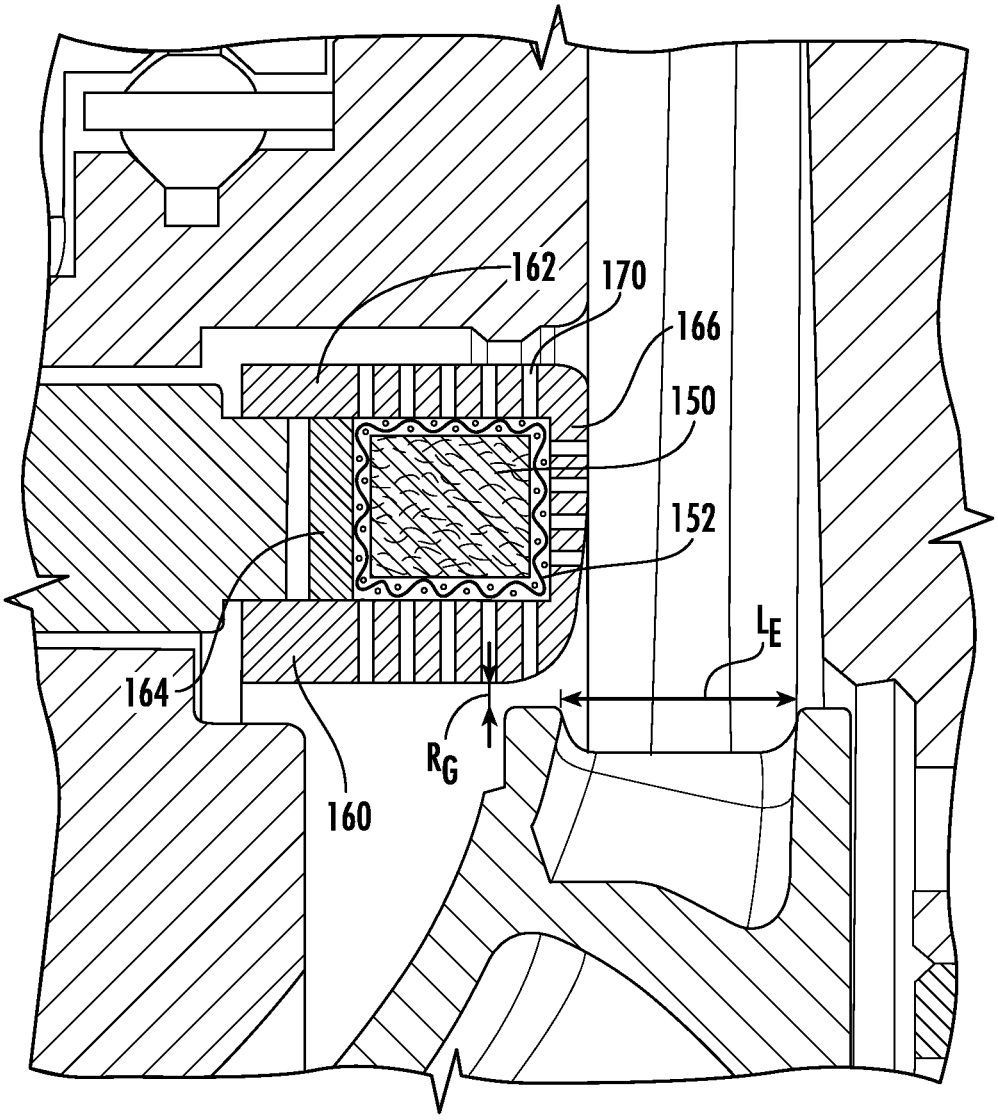
FIG. 6 is an alternative longitudinal sectional view of the ring in a fully retracted position.
Figure 7:
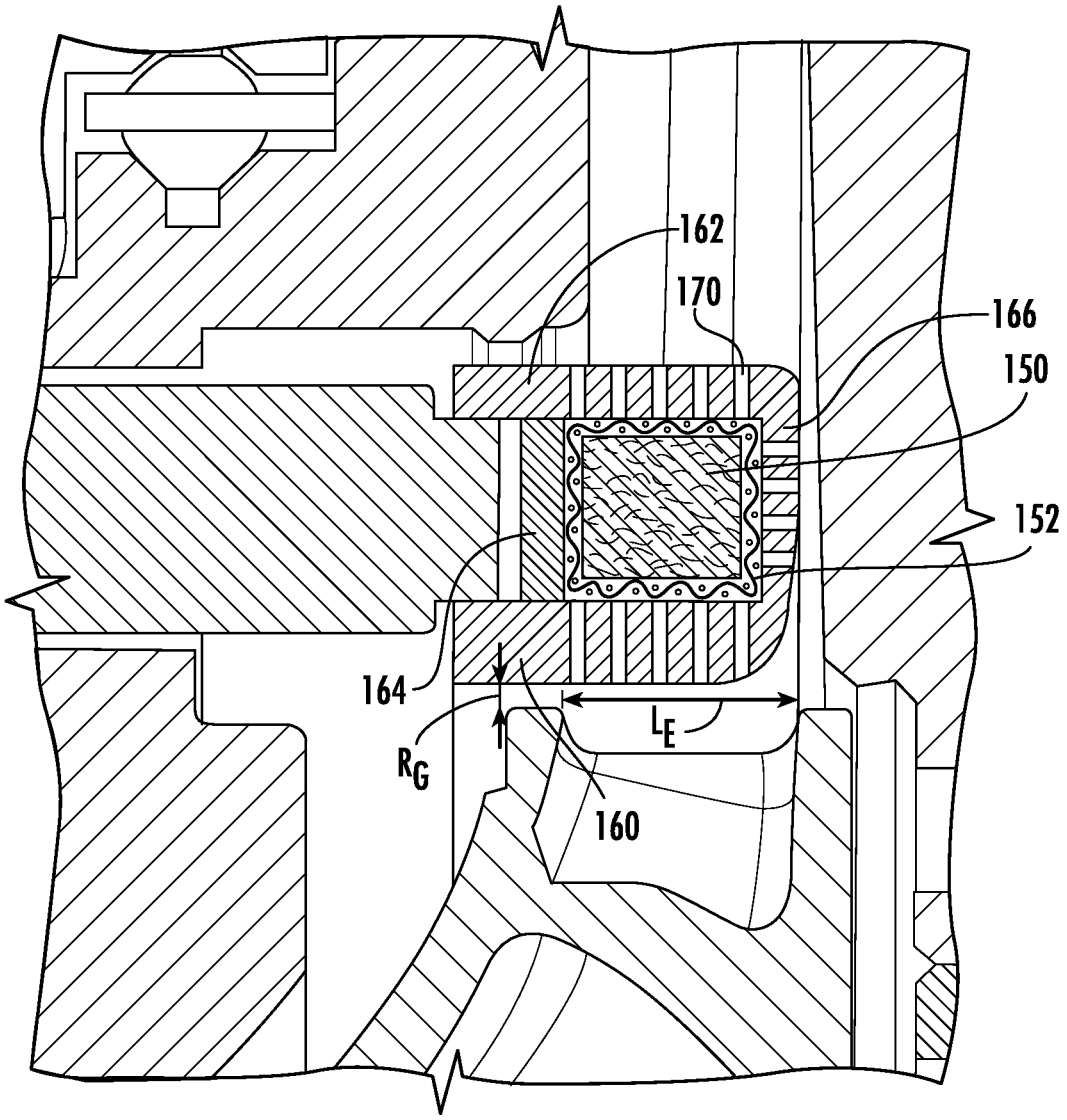
FIG. 7 is an alternative longitudinal sectional view of the ring in a fully inserted position.

As so far described, the compressor may be illustrative of one or more of several baseline configurations. However, FIGS. 4 and 5 show a modification of the baseline (e.g., a reengineering or a remanufacturing) wherein a monolithic metal diffuser restriction ring of the baseline is replaced by a ring having pulsation absorbing or damping material 150. Exemplary material 150 includes glass fiber (e.g., compressed batting), polymeric material such as fiber, foam, or expanded bead material (e.g., porous expanded polypropylene (PEPP)), and combinations. The material 150 may, itself, be encased within a jacket 152 such as glass, polymer, or metallic mesh or fabric. In the exemplary configuration, the material is arranged in a circumferential array of segments to fit individual segments circumferentially between screws securing the ring to its carrier.

One source of pulsation is impeller discharge. A primary pulsation is at the passing frequency of the second stage impeller (impeller frequency multiplied by the number of blades on the impeller). These pulsations are strongest at the impeller outlet. The sound-absorbing material has porosity that may fill with refrigerant vapor. The high frequency pulsations may bounce off other surfaces of the compressor and encounter the ring. Vibrations passed through the holes (or even radiated through intact portions of the ring metallic structure) will encounter the pulsation absorbing material 150. The pulsations may reflect within the material and, due to friction between the vapor and the fibers or other material may partially dissipate as heat.

Another source of pulsation is from the upstream first stage impeller blade passing frequency. Yet another source of pulsation is from the interaction between return 62 (also known as diaphragm) vane trailing edges and the second stage impeller blade leading edges. This interaction will generate frequencies such as return/diaphragm vane count times the impeller rotational speed and the difference in vane and blade count times the rotational speed.

The material 150 may be enclosed between a radially inboard portion 160 of the ring and a radially outboard portion 162. The exemplary configuration also includes end portions (endplates) 164 and 166 (FIG. 5) radially spanning between the portions 160 and 162. The four portions 160, 162, 164, and 166, if present, may be separately formed and assembled to each other or may represent portions of larger bodies (e.g., several of the portions might be machined as a single piece). In the illustrated example, the portions 160, 162, and 166 are machined as an axially-open channel which is then closed by securing portion 164 in place such as by brazing or fasteners.

In this configuration, the portions 160 and 162 form respective radial layers of the ring sandwiching the material 150 radially between. The exemplary inboard layer 160 and outboard layer 162 are foraminate (having holes 170 allowing communication with the material 150). Exemplary holes may be drilled, formed by perforation, or the like. The particular hole forming technique may depend on thickness of the layers. The endplate 166 may also have such holes.

FIG. 4 shows an overall ring thickness $T_R$. Exemplary $T_R$ may be measured as a median, modal, mean, or other characteristic value of a portion of the ring which, during its range of travel, may find itself radially outboard of the impeller outlet. As is discussed further below, particular values of $T_R$ may depend upon particular baselines of compressors. The example of FIG. 3 has a relatively high ratio of $T_R$ to the axial length $L_E$ (FIG. 5) of the impeller exit. This baseline also has a relatively small radial gap $R_G$ between impeller exit and the inner diameter (ID) surface of the ring. In contrast, the aforementioned Endress patent shows a relatively thinner ring. This Endress thickness is approximately half the impeller exit length. Yet other baselines may have a greater proportional radial gap than that shown. Particularly when engineering a baseline compressor having a relatively thin ring, one possible reengineered or remanufactured version involves maintaining only a robust outer portion 162 and using the material 150 as a mere liner (directly exposed (optionally via its jacket)) to flow exiting the impeller exit. In yet other variations, a relatively non-robust inboard portion 160 may be used (e.g., perforated sheetmetal).

In general, exemplary overall thicknesses of the jacketed material and the associated compartment in the ring may be represented by $T_c$ in FIG. 4. The thickness of the material 150 may be a slightly lower value $T_F$. However, these will be close to each other and only one set of exemplary values of this thickness is given. For example, such thickness $T_c$ or $T_F$ may be in a range of 3 mm to 20 mm or 5 mm to 15 mm, or at least 3 mm, or at least 5 mm or at least 10 mm.

The compressor may be made using otherwise conventional or yet-developed materials and techniques and may be operated in otherwise conventional or yet-developed methods and systems. In addition to original manufacture processes, the compressor may be made as a remanufacturing or retrofit of an existing compressor lacking the pulsation absorbing/damping. For example an existing compressor may have a monolithic metallic ring which may be removed and replaced with a ring 90 having pulsation damping means. A typical baseline two-stage compressor may only have a control ring on the second stage (IGV control may moot this for the first stage). Addition of the pulsation damping only to the second stage is still effective because the second stage involves higher pressure pulses that are a more significant vibration source and because, being downstream, the second stage means may still absorb residual pulsations from the first stage.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A centrifugal compressor (20) comprising:
a housing (26);
an impeller (34) having an axial inlet (70) and a radial outlet (72);
a diffuser (82); and
a control ring (90) mounted for shifting between an inserted position and a retracted position, wherein the control ring comprises:
means (150, 160, 162, 166) for absorbing pulsations.

2. The centrifugal compressor of claim 1 wherein:
the means absorbs said pulsations associated with a passing frequency of the impeller.

3. The centrifugal compressor of claim 1 wherein:
the means comprises a sleeve portion of the control ring having a pulsation-damping material (150).

4. The centrifugal compressor of claim 1 wherein:
the means comprises a sleeve portion of the control ring having a foraminate layer (160, 162, 166).

5. A centrifugal compressor (20) comprising:
a housing (26);
an impeller (34) having an axial inlet (70) and a radial outlet (72);
a diffuser (82); and
a control ring (90) mounted for shifting between an inserted position and a retracted position, wherein the control ring comprises:
a sleeve portion having a foraminate layer (160, 162, 166).

6. The centrifugal compressor of claim 5 wherein:
the sleeve portion of the control ring has a pulsation-damping material.

7. The centrifugal compressor of claim 6 wherein:
the foraminate layer is a radially inboard foraminate layer (160);
the sleeve portion has a radially outboard foraminate layer (162); and
the pulsation-damping material (150) is between the inboard foraminate layer and the outboard foraminate layer.

8. The centrifugal compressor of claim 6 wherein:
the pulsation-damping material comprises fiber.

9. The centrifugal compressor of claim 6 wherein:
the pulsation-damping material comprises expanded bead material.

10. The centrifugal compressor of claim 6 wherein:
the pulsation-damping material comprises a circumferential array of segments.

11. The centrifugal compressor of claim 6 wherein:
the pulsation-damping material has a thickness of at least 3 mm.

12. The centrifugal compressor of claim 5 wherein:
the foraminate layer is metallic.

13. The centrifugal compressor of claim 5 wherein:
the foraminate layer comprises drilled holes (170).

14. The centrifugal compressor of claim 5 wherein:
the diffuser is a pipe diffuser.

15. The centrifugal compressor of claim 5 wherein:
the impeller is a shrouded impeller.

16. The centrifugal compressor of claim 5 wherein:
the compressor is a two-stage compressor; and
the impeller is a second stage impeller downstream of a first stage impeller.

17. A method for using the centrifugal compressor of claim 5, the method comprising:
rotating the impeller to drive a fluid flow; and
shifting the control ring between the retracted position and the inserted position.

18. The method of claim 17 wherein:
the shifting is a combined axial shift along an axis of the impeller and a rotation about the axis.

19. The method of claim 17 wherein:
during the shifting, the foraminate layer contacts the fluid flow.

20. A method for manufacturing the centrifugal compressor of claim 5, the method comprising:
removing a first control ring lacking said foraminate layer; and
installing said control ring in place of said first control ring.

21. The method of claim 20 wherein:
said first control ring is a monolithic metallic ring.

* * * * *